US007410232B2

(12) United States Patent
Takahashi

(10) Patent No.: US 7,410,232 B2
(45) Date of Patent: Aug. 12, 2008

(54) INK-DROPLET EJECTING APPARATUS

(75) Inventor: Yoshikazu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 350 days.

(21) Appl. No.: 11/249,319

(22) Filed: Oct. 14, 2005

(65) Prior Publication Data

US 2006/0082607 A1 Apr. 20, 2006

(30) Foreign Application Priority Data

Oct. 14, 2004 (JP) ..... 2004-300456

(51) Int. Cl.
*B41J 29/38* (2006.01)

(52) U.S. Cl. ..... 347/11

(58) Field of Classification Search ..... 347/11
See application file for complete search history.

(56) References Cited

U.S. PATENT DOCUMENTS 6,412,923 B1 7/2002 Takahashi
6,523,923 B2 2/2003 Sekiguchi
6,663,208 B2 12/2003 Suzuki et al.
2001/0018388 A1 8/2001 Moser et al.
2003/0146956 A1 8/2003 Takahashi
2004/0246315 A1 12/2004 Takahashi

FOREIGN PATENT DOCUMENTS

JP 2000052561 2/2000
JP 2002-160362 A 6/2002
JP 2003145750 5/2003
JP 2003231263 8/2003

*Primary Examiner*—Julian D Huffman
(74) *Attorney, Agent, or Firm*—Banner & Witcoff, Ltd.

(57) ABSTRACT

An ink-droplet ejecting apparatus includes a nozzle; an ink pressure chamber; an actuator which produces a pressure wave in the ink; and a control device which, when a first print command corresponding to a first print period for ejecting the ink and a second print command corresponding to a second print period next to the first print period for ejecting the ink, outputs, within the first print period, a first drive waveform for driving the actuator, and which, when the first print command is to eject the ink and the second print command is not to eject the ink, outputs a second drive waveform extending over the first and second print periods. The control device outputs, as the second drive waveform, a first ejecting pulse signal, then a first canceling pulse signal, then a second ejecting pulse signal and then a second canceling pulse signal driving the actuator.

7 Claims, 10 Drawing Sheets

FIG.7A

EXAMPLE 1
LENGTH OF FIRST CANCFL PULSE IS 1.3AL TO 1.8AL
LENGTH OF SECOND CANCEL PULSE IS 1.3AL TO 1.8AL
TIME INTERVAL BETWEEN FIRST CANCEL PULSE AND SECOND EJECTION PULSE IS 3.0AL TO 4.5AL

| FREQUENCY(kHz) / DUTY% | ← 20kHz±10% → | | | | | ← 24kHz±10% → | | | | |
|---|---|---|---|---|---|---|---|---|---|---|
| | 18 | 19 | 20 | 21 | 22 | 21.6 | 22.8 | 24 | 25.2 | 26.4 |
| 50.0% | × | × | × | × | × | × | × | × | × | × |
| 33.0% | O | O | O | O | Δ | O | O | O | Δ | O |
| 25.0% | × | × | × | × | × | × | × | × | × | × |
| 12.5% | O | O | O | O | O | O | O | O | O | O |

FIG.7B

EXAMPLE 2
LENGTH OF FIRST CANCEL PULSE IS 0.3AL TO 0.4AL
LENGTH OF SECOND CANCEL PULSE IS 0.3AL TO 0.4AL
TIME INTERVAL BETWEEN FIRST CANCELPULSE AND SECOND EJECTION PULSE IS 3.0AL TO 4.5AL

| FREQUENCY(kHz) / DUTY% | ← 20kHz±10% → | | | | | ← 24kHz±10% → | | | | |
|---|---|---|---|---|---|---|---|---|---|---|
| | 18 | 19 | 20 | 21 | 22 | 21.6 | 22.8 | 24 | 25.2 | 26.4 |
| 50.0% | × | × | × | × | × | × | × | × | × | × |
| 33.0% | × | × | × | × | × | × | × | × | × | × |
| 25.0% | O | O | O | O | Δ | O | O | Δ | Δ | Δ |
| 12.5% | O | O | O | O | O | O | O | O | .O | O |

FIG.7C

EXAMPLE 3
LENGTH OF FIRST CANCEL PULSE IS 0.3AL TO 0.4AL
LENGTH OF SECOND CANCEL PULSE IS 1.3AL TO 1.8AL
TIME INTERVAL BETWEEN FIRST CANCEL PULSE AND SECOND EJECTION PULSE IS 3.0AL TO 4.5AL

| FREQUENCY(kHz) / DUTY% | ← 20kHz±10% → | | | | | ← 24kHz±10% → | | | | |
|---|---|---|---|---|---|---|---|---|---|---|
| | 18 | 19 | 20 | 21 | 22 | 21.6 | 22.8 | 24 | 25.2 | 26.4 |
| 50.0% | O | O | O | O | Δ | Δ | Δ | Δ | Δ | Δ |
| 33.0% | O | O | O | O | × | Δ | × | × | × | × |
| 25.0% | × | × | Δ | × | O | O | O | O | O | O |
| 12.5% | O | O | O | O | O | O | O | O | O | O |

FIG.7D

EXAMPLE 4
LENGTH OF FIRST CANCEL PULSE IS 1.3AL TO 1.8AL
LENGTH OF SECOND CANCEL PULSE IS 0.3AL TO 0.4AL
TIME INTERVAL BETWEEN FIRST CANCEL PULSE AND SECOND EJECTION PULSE IS 0.5AL TO 2.5AL

| FREQUENCY(kHz) / DUTY% | ← 20kHz±10% → | | | | | ← 24kHz±10% → | | | | |
|---|---|---|---|---|---|---|---|---|---|---|
| | 18 | 19 | 20 | 21 | 22 | 21.6 | 22.8 | 24 | 25.2 | 26.4 |
| 50.0% | O | O | O | Δ | × | × | × | × | × | × |
| 33.0% | O | O | O | O | × | Δ | × | × | × | × |
| 25.0% | × | × | Δ | O | O | O | O | O | O | O |
| 12.5% | O | O | O | O | O | O | O | O | O | O |

FIG.7E

EXAMPLE 5
LENGTH OF FIRST CANCEL PULSE IS 1.3AL TO1.8AL
LENGTH OF SECOND CANCEL PULSE IS 0.3AL TO 0.4AL
TIME INTERVAL BETWEEN FIRST CANCEL PULSE AND SECOND EJECTION PULSE IS5.0AL TO 6.0AL

| FREQUENCY(kHz) / DUTY% | ← 20kHz±10% → | | | | | ← 24kHz±10% → | | | | |
|---|---|---|---|---|---|---|---|---|---|---|
| | 18 | 19 | 20 | 21 | 22 | 21.6 | 22.8 | 24 | 25.2 | 26.4 |
| 50.0% | O | O | O | O | O | Δ | Δ | Δ | × | × |
| 33.0% | Δ | Δ | Δ | Δ | Δ | Δ | Δ | Δ | Δ | Δ |
| 25.0% | O | O | O | O | Δ | Δ | Δ | Δ | Δ | Δ |
| 12.5% | O | O | O | O | O | O | O | O | O | O |

FIG.7F

EXAMPLE 6
LENGTH OF FIRST CANCEL PULSE IS 1.3AL TO1.8AL
LENGTH OF SECOND CANCEL PULSE IS 0.3AL TO 0.4AL
TIME INTERVAL BETWEEN FIRST CANCEL PULSE AND SECOND EJECTION PULSE IS 3.0AL TO 4.5AL

| FREQUENCY(kHz) / DUTY% | ← 20kHz±10% → | | | | | ← 24kHz±10% → | | | | |
|---|---|---|---|---|---|---|---|---|---|---|
| | 18 | 19 | 20 | 21 | 22 | 21.6 | 22.8 | 24 | 25.2 | 26.4 |
| 50.0% | O | O | O | O | O | O | O | O | O | O |
| 33.0% | O | O | O | O | O | O | O | O | O | O |
| 25.0% | O | O | O | O | O | O | O | O | O | O |
| 12.5% | O | O | O | O | O | O | O | O | O | O |

FIG.8

| PRINT PPERIOD | ← To → | ← To → | ← To → | ← To → | ← To → | ← To → |
|---|---|---|---|---|---|---|
| 50%duty DOT INFORMATION | ○ | × | ○ | × | ○ | × |
| 33%duty DOT INFORMATION | ○ | × | × | ○ | × | × |
| 25%duty DOT INFORMATION | ○ | × | × | × | ○ | × |

INK-DROPLET EJECTING APPARATUS

The present application is based on Japanese Patent Application No. 2004-300456 filed on Oct. 14, 2004, the contents of which are incorporated herein by reference.

BACKGROUND OF THE INVENTION

1. Field of the Invention

The present invention relates to an ink-droplet ejecting apparatus of an inkjet type that drives an actuator to produce a pressure wave or vibration in a pressure chamber and thereby eject a droplet of ink from a nozzle.

2. Discussion of Related Art

There has been known an ink-droplet ejecting device including an ink ejection nozzle, a pressure chamber (i.e., an ink chamber) that is provided in rear of the nozzle and is filled with ink, an actuator that changes a volume of the pressure chamber, and a control device that drives the actuator to produce a pressure wave or vibration in the pressure chamber and thereby eject a droplet of the ink from the nozzle.

For example, Patent Document 1 (Japanese Patent Application Publication No. P2003-231263A or its corresponding U.S. Patent Application Publications Nos. 2003/0146956A1 and 2004/0246315A1 or Patent Document 2 (Japanese Patent Application Publication No. P2003-145750A or its corresponding U.S. Pat. No. 6,523,923) discloses a piezoelectric actuator that utilizes a piezoelectric effect that when a drive voltage is applied to a piezoelectric element, an elastic deformation of the element occurs. In the disclosed piezoelectric actuator, first piezoelectric sheets (i.e., piezoelectric-ceramics sheets) on each of which an individual-electrode layer including a plurality of individual electrodes is formed, and second piezoelectric sheets on each of which a common-electrode layer constituting a common electrode is formed are stacked alternately on each other. A high electric voltage is applied to all pairs of individual electrode and common electrode so as to polarize, in advance, respective portions of the piezoelectric sheets that are sandwiched by the respective pairs of individual electrode and common electrode and thereby form the sandwiched portions into active portions. When a drive pulse having a low electric voltage is applied to an arbitrary pair of individual electrode and common electrode, according to a print command, a corresponding one of the active portions is elastically deformed in the direction of stacking of the piezoelectric sheets, and accordingly a volume of a corresponding one of pressure chambers is changed.

Patent Document 3 (Japanese Patent Application Publication No. P2000-052561A or its corresponding U.S. Pat. No. 6,412,923) discloses another piezoelectric actuator in which actuator walls provided on either side of a pressure chamber (an ink chamber) are deformed in a piezoelectric shear mode and accordingly a volume of the pressure chamber is changed.

In each of the above-described piezoelectric actuators, if a pressure wave is applied to, and canceled from, the pressure chamber at a timing corresponding to a period at which each pressure wave propagates one way in the pressure chamber in a longitudinal direction thereof that is, if a pressure wave is applied at a timing when the pressure of the ink in the pressure chamber increases and a pressure wave is canceled at a timing when the pressure of the ink in the pressure chamber decreases, the pressure wave is amplified so that the second ink droplet next to the first ink droplet is ejected more strongly than the first ink droplet, and so on. Thus, the ink can be ejected with improved pressure efficiency.

In particular, in the piezoelectric actuator disclosed by Patent Document 2, a plurality of drive pulse signals are applied according to one print command, so that a plurality of ink droplets are ejected from one nozzle and one dot is formed with a large amount of ink on a recording sheet as a sort of recording medium. Thus, an image having a high density can be printed on the recording sheet.

Meanwhile, in the piezoelectric actuator disclosed by Patent Document 3, two ink ejecting actions occur to eject two ink droplets and thereby form one dot, in such a manner that a first ejection pulse signal is applied to eject a first ink droplet, and then a first non-ejection pulse signal is applied to cancel a pressure wave produced by the first ink ejecting action Subsequently, in a state in which the pressure in a pressure chamber has been sufficiently stabilized, a second ejection pulse signal is applied to eject a second ink droplet, and then a second non-ejection pulse signal is applied to cancel a pressure wave produced by the second ink ejecting action. Thus, it is said that even if a frequency at which the actuator is driven may be more or less changed, an image can be printed with good quality.

However, recently, inkjet image recording devices have been required to record images at higher speeds. That is, an actuator that can be driven at higher frequencies to eject ink droplets is demanded.

In addition, inkjet image recording devices have been required to record images with a printing quality comparable to that of photographic images, in such a manner that the recorded images have many colors and many halftones, that is, an amount of an ink droplet corresponding to one pressure wave is small and a total number of dots formed in unit area on a recording sheet is great. That is, an actuator that can be used with a nozzle having a small diameter is demanded.

In particular, in the case where ink ejection commands are discontinued from each other by a non-ejection command, that is, a print period corresponding to an ink ejection command is followed by another print period corresponding to a non ejection command, if an ink droplet is erroneously ejected toward a position on a recording sheet where no ink should be ejected, a quality of an image formed on the recording sheet is significantly lowered. Hence, Patent Document 3 teaches applying, after applying an ejection pulse signal, a cancel pulse signal so as not to eject an ink droplet toward a position where no ink should be ejected.

Moreover, when an environmental temperature around an ink-droplet ejecting device, that is, a temperature of ink increases, a viscosity of the ink decreases. In other words, when the environmental temperature decreases, the viscosity of the ink increases. Thus, in order to prevent ejection of an excessively large, or small, amount of ink (i.e., an excessively large or small volume of each ink droplet), it is needed to control accurately a timing when a cancel pulse signal is applied after application of an ejection pulse signal and/or a pulse length of the cancel pulse signal.

SUMMARY OF THE INVENTION

It is therefore an object of the present invention to solve at least one of the above-indicated problems. It is another object of the present invention to provide an ink-droplet ejecting apparatus that can record an image with a stable quality by using ejection pulse signals and cancel pulse signals respective pulse lengths of which and a pulse interval between two pulse signals of which are determined based on a one-way propagation time of a pressure wave.

The above objects may be achieved according to the present invention. According to the present invention, there is provided an ink-droplet ejecting apparatus, comprising a nozzle from which a droplet of an ink is ejected; a pressure chamber which is filled with the ink and is connected to the nozzle; an actuator which changes a volume of the pressure chamber and thereby changes a pressure of the ink in the pressure chamber; and a control device which, when a first print command corresponding to a first pixel and a first print period is to eject the ink and a second print command corresponding to a second pixel next to the first pixel and a second print period next to the first print period is to eject the ink, outputs, within the first print period, a first drive waveform so as to drive, a plurality of times, the actuator to produce a plurality of pressure waves, respectively, in the pressure chamber and thereby eject a plurality of droplets of the ink, respectively, from the nozzle to form the first pixel, and which, when the first print command is to eject the ink and the second print command is not to eject the ink, outputs a second drive waveform extending over the first and second print periods. The control device outputs, as the second drive waveform, a first ejecting pulse signal, then a first canceling pulse signal, then a second ejecting pulse signal and then a second canceling pulse signal, so as to drive, two times, the actuator to produce two pressure waves, respectively, in the pressure chamber and thereby eject two droplets of the ink, respectively, from the nozzle to form the first and second pixels, respectively. Each of the first and second ejecting pulse signals has a pulse length falling in a range of from 0.8AL to 1.2AL, where AL is a one-way propagation time needed for each of the two pressure waves to propagate one way in an ink flow passage which includes the pressure chamber and is connected to the nozzle. The first canceling pulse signal has a pulse length filling in a range of from 1.3AL to 1.8AL. The second canceling pulse signal has a pulse length falling in a range of from 0.3AL to 0.4AL. A time interval between a trailing end of the first canceling pulse signal and a leading end of the second ejecting pulse signal falls in a range of from 3.0AL to 4.5AL.

In the ink-droplet ejecting apparatus in accordance with the present invention, the second drive waveform includes the first and second ejection pulse signals and the first and second cancel pulse signals that have the above-indicated pulse lengths and the above-indicated pulse interval between the first cancel pulse signal and the second ejection pulse signal. Therefore, even if a plurality of print periods corresponding to a plurality of ink ejection commands, respectively, are discontinued from each other by a print period corresponding to a non-ejection command, failure of ejection of an ink droplet or deflection of an ejected ink droplet does not occur, i.e., ink droplets can be ejected with stability.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIGS. 7A, 7B, 7C, 7D, 7E, and 7F are tables showing respective results of six experiments with respect to different second drive waveforms in which respective pulse lengths of two canceling pulse signals and/or a pulse interval between two pulse signals are changed;

FIG. 8 is a table showing a relationship between duty percentage and dot information.

DETAILED DESCRIPTION OF THE PREFERRED EMBODIMENTS

Figure 1:
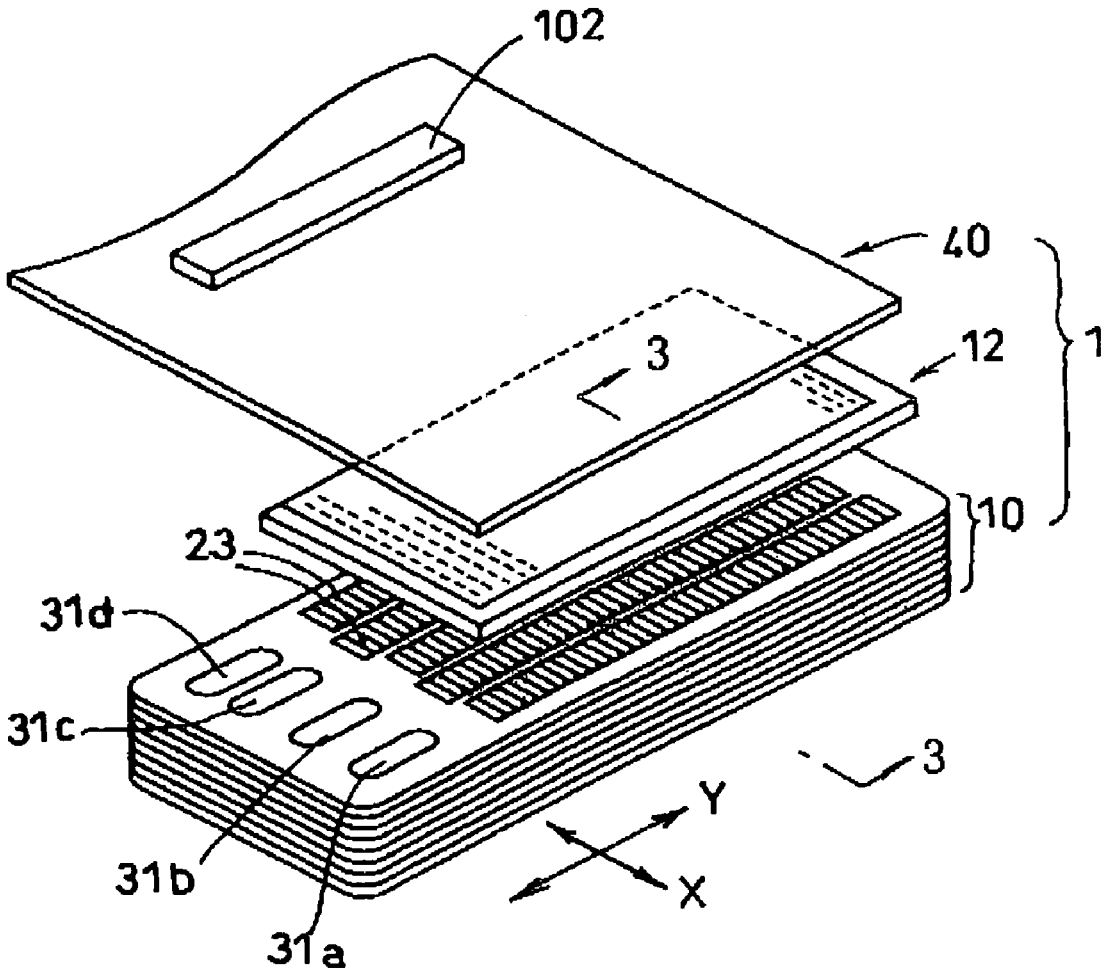
FIG. 1 is a perspective view of an inkjet recording head of an inkjet recording apparatus to which the present invention is applied, in a state in which a cavity unit, a piezoelectric actuator, and a flexible flat cable of the recording head are separated from each other.
Figure 2:
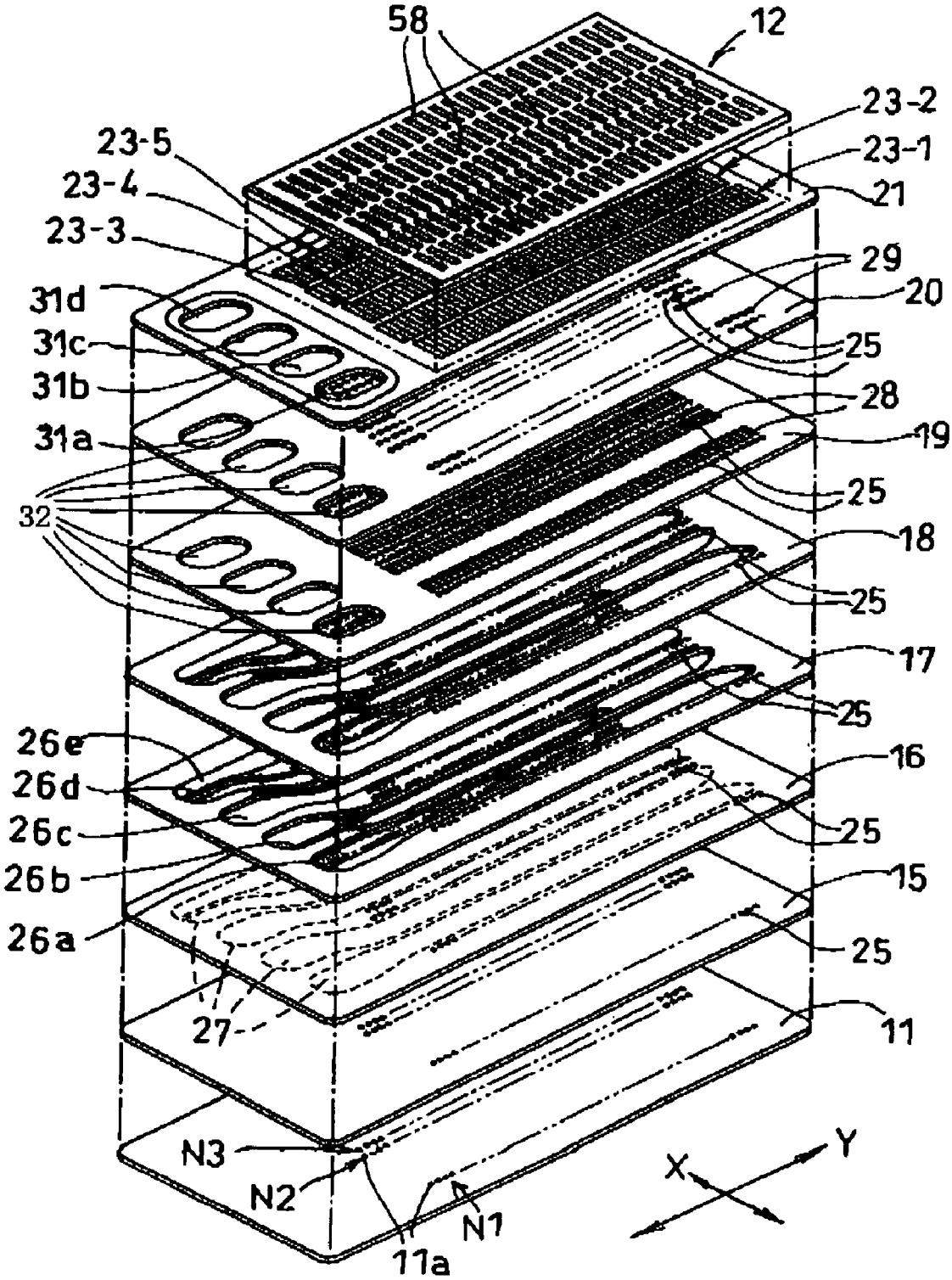
FIG. 2 is an exploded, perspective view of the cavity unit.
Figure 3:
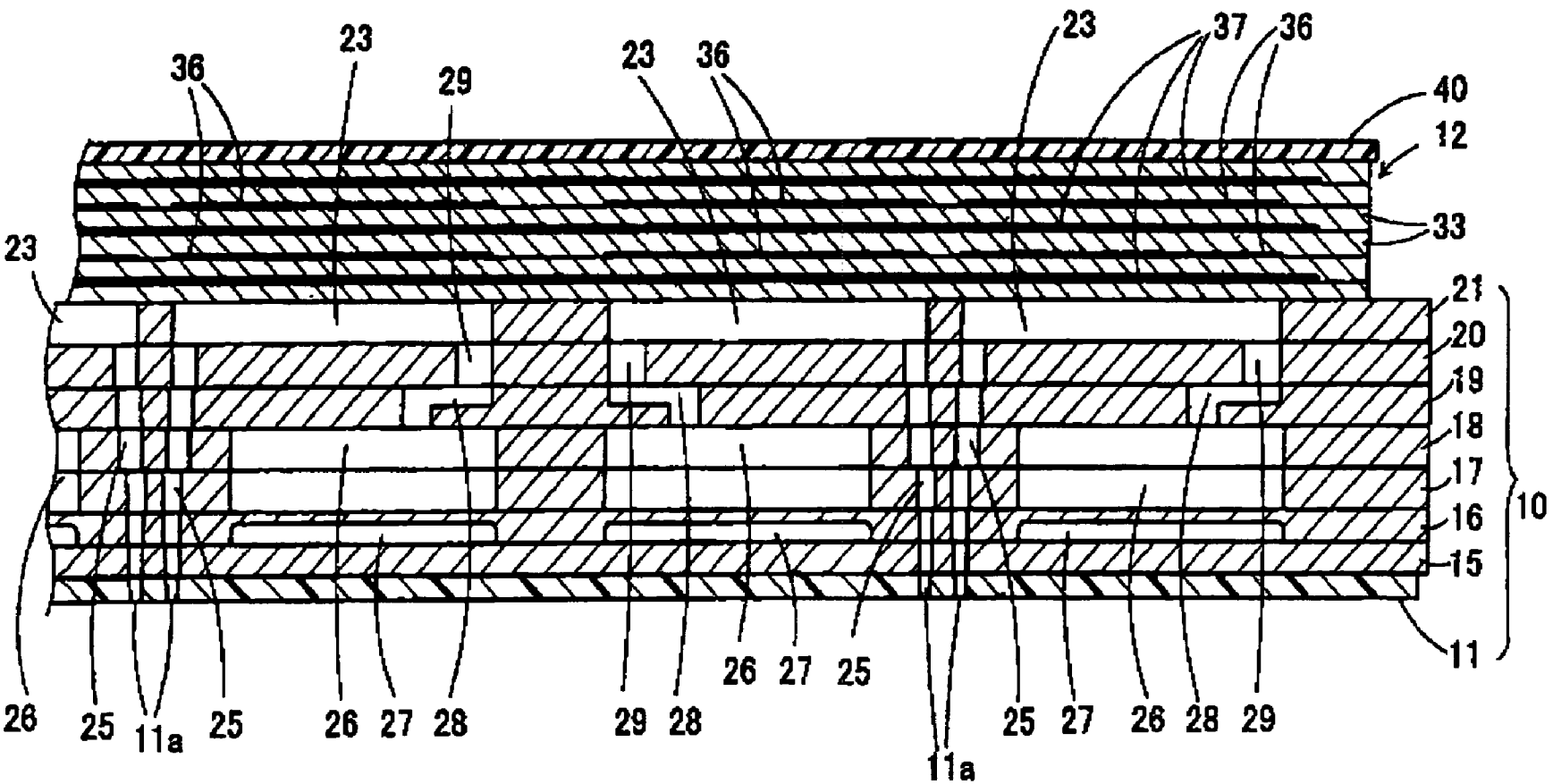
FIG. 3 is an enlarged, cross-section view taken along 3-3 in FIG. 1.
Figure 4:
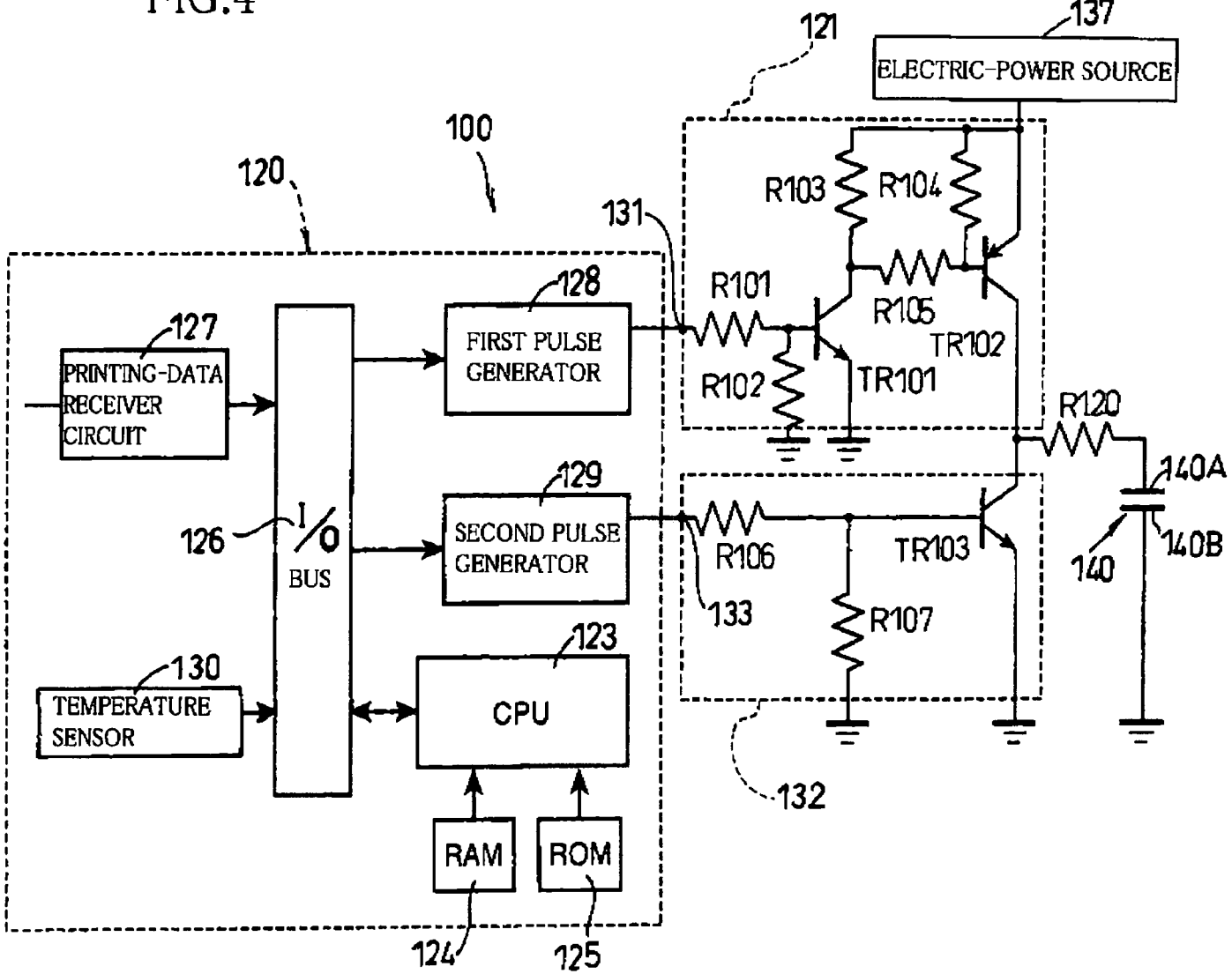
FIG. 4 is a diagrammatic view of a control device of the inkjet recording apparatus that controls the inkjet recording head.

Hereinafter, there will be described a preferred embodiment of the present invention by reference to the drawings. FIG. 1 shows a full-color inkjet recording head 1 of an ink-droplet ejecting apparatus to which the present invention relates. The full-color inkjet recording head 1 includes a cavity unit 10 and a piezoelectric actuator 12, and the ink-droplet ejecting apparatus further includes an actuator control device 100 (FIG. 4). FIG. 2 shows a plurality of sheet members 11 and 15 through 21 of the cavity unit 10; FIG. 3 shows respective cross-section views of the cavity unit 10 and the actuator 12; and FIG. 4 shows an electric circuit of the control device 100.

The full-color inkjet recording head 1 is mounted on a carriage, not shown, of the inkjet recording apparatus that is reciprocated in a first direction (hereinafter, referred to as the "X direction"). A recording sheet as a sort of recording medium is fed in a second direction (hereinafter, referred to as the "Y direction") perpendicular to the first, i.e., X direction. Four ink cartridges that respectively store four color inks, e.g., cyan, magenta, yellow, and black inks, are mounted on, or attached to, the carriage, such that each of the four ink cartridges is detachable from the carriage. However, the four ink cartridges may be provided on a stationary member of the image recording apparatus. In the latter case, the four color inks may be supplied from the four ink cartridges provided on the stationary member, via respective supply pipes, not shown, to respective damper chambers, not shown, provided on the carriage.

As shown in FIG. 2, the inkjet recording head 1 includes the cavity unit 10 having a plurality of ink ejection nozzles 11*a* in a front (or a lower) surface of the recording head 1; the piezoelectric actuator 12 of a sheet type in which the sheet members 11, 15 through 21 are stacked on each other and which is adhered to an upper surface of the cavity unit 10 via an adhesive material or sheet; and a flexible flat cable 40 (FIG. 1) as a sort of wiring substrate that is bonded to a back (or an upper) surface of the actuator 12 so that the actuator 12 may be electrically connected via the cable 40 to external devices, i.e., a driver IC 102 (FIG. 1) and the actuator control device 100.

The cavity unit 10 has a construction shown in FIG. 2. More specifically described, the cavity unit 10 includes eight flat sheet members that are stacked on, and bonded with adhesive to, each other. The eight sheet members include, in the order from the bottom, to the top, of the cavity unit 10, a nozzle sheet 11, an intermediate sheet 15, a damper sheet 16, two manifold sheets 17, 18, two spacer sheets 19, 20, and a base sheet 21. The base sheet 21 has a plurality of pressure chambers 23 arranged in five arrays 23-1, 23-2, 23-3, 23-4, 23-5. Each of the sheet members 16 through 21 other than the nozzle sheet 11 formed of a synthetic resin, is formed of a 42% nickel alloy steel sheet, and each of the metallic sheet members 15 through 21 has a thickness of from about 50 μm to about 150 μm.

The nozzle sheet 11 has the ink ejection nozzles 11*a* each having a small diameter, such that the nozzles 11*a* are arranged in five arrays N including three arrays N1, N2, N3, and one pair of arrays of nozzles N2, N3 are arranged in a staggered or zigzag fashion in the second, i.e., Y direction, i.e., a lengthwise direction of the cavity unit 10 or the recording head 1. FIG. 2 shows only the three arrays of nozzles N1, N2, N3, i.e., does not show the other two arrays of nozzles N4, N5 that, like the pair of arrays of nozzles N2, N3, are paired with each other and are arranged in a zigzag fashion in the Y direction. The five arrays of nozzles N1 through N5 are distant from each other in the X direction. In the present embodiment, each of the five arrays of nozzles N1 through N5 has a length of one inch, and consists of 75 nozzles 11*a*. Thus, the recording head 1 has a nozzle density of 75 dpi (dot per inch). An open end of each nozzle 11*a* that opens toward an outside space has a diameter of from 18 μm to 22 μm.

In FIG. 2, the first array of nozzles N1 corresponds to the cyan ink (C); the second array of nozzles N2 corresponds to the yellow ink (Y); the third array of nozzles N3 corresponds to the magenta ink (M); and the fourth and fifth arrays of nozzles N4, N5 (not shown) correspond to the black ink (B).

Each of the two, i.e., lower and upper manifold sheets 17, 18 has five openings that are elongate in the Y direction, are formed through a thickness thereof, and correspond to the five arrays of nozzles N1 through N5, respectively. Since the two manifold sheets 17, 18 are sandwiched by the first spacer sheet 19 provided on the upper manifold sheet 18 and the damper sheet 16 provided under the lower manifold sheet 17, the above-described five elongate openings define five common ink chambers (i.e., five manifold chambers) 26 (26*a*, 26*b*, 26*c*, 26*d*, 26*e*), respectively. In FIG. 2, the first common ink chamber 26*a* corresponds to the cyan ink (C); the second common ink chamber 26*b* corresponds to the yellow ink (Y); the third common ink chamber 26*c* corresponds to the magenta ink (M); and the fourth and fifth common ink chambers 26*d*, 26*e* correspond to the black ink (B).

As shown in FIG. 2, the base sheet 21 has, in one end portion thereof as seen in the Y direction, four ink supply inlets 31 (31*a*, 31*b*, 31*c*, 31*d*) that are distant from each other in the X direction and are formed through a thickness thereof. The three ink supply inlets 31*a*, 31*b*, 31*c* communicate with the three common ink chambers 26*a*, 26*b*, 26*c*, respectively; and the fourth ink supply inlet 31*d* commonly communicates with respective one end portions of the fourth and fifth common ink chambers 26*d*, 26*e* that are located near to each other. Each of the first and second spacer sheets 19, 20 has, in one end portion thereof as seen in the Y direction, four ink supply passages 32 at respective positions corresponding to the four ink supply inlets 31*a*, 31*b*, 31*c*, 31*d*, so that the three ink supply inlets 31*a*, 31*b*, 31*c* communicate with the three common ink chambers 26*a*, 26*b*, 26*c* via the three ink supply passages 32, respectively; and the fourth ink supply inlet 31*d* commonly communicates with the fourth and fifth common ink chambers 26*d*, 26*e* via the fourth ink supply passage 32.

The damper sheet 16, adhered to the lower surface of the lower manifold sheet 17, has, in a lower surface thereof, five damper chambers 27 that are elongate in the Y direction, open in the lower surface only (i.e., do not open in an upper surface thereof), and are formed at respective positions corresponding to the five common ink chambers 26. Since the five damper chambers 27 are closed by the intermediate sheet 15 provided under the lower surface of the damper sheet 16, the five damper chambers 27 are gas-tightly closed.

When the piezoelectric actuator 12, described later, is driven or operated, a pressure wave is applied to an arbitrary one of the pressure chambers 23 of the base sheet 21. The thus applied pressure wave includes a backward component that propagates through the ink toward a corresponding one of the common ink chambers 26. However, owing to the above-described arrangement of the damper sheet 16, the backward component can be effectively absorbed by vibration of a thin diaphragm (i.e., a thin ceiling wall) of the damper sheet 16 that defines one of the damper chambers 27 that corresponds to the one common ink chamber 26. Thus, occurrence of so-called "cross-talking" can be effectively prevented.

The base sheet 21 has the five arrays of pressure chambers 23-1, 23-2, 23-3, 23-4, 23-5 corresponding to the five arrays of ink ejection nozzles N1, N2, N3, N4, N5, respectively, such that each of the pressure chambers 23 is elongate in the X direction. The pressure chambers 23 are formed through the thickness of the base sheet 21, such that the pressure chambers 23 correspond, one to one, to the ink ejection nozzles 11*a*. One of two lengthwise opposite end portions of each of the pressure chambers 23 of each of the five arrays 23-1, 23-2, 23-3, 23-4, 23-5 communicates with a corresponding one of the five common ink chambers 26 via a corresponding one of communication holes 29 formed through the thickness of the second spacer sheet 20, and a corresponding one of restrictor passages 28 formed in the first spacer sheet 19, and the other end portion of the each pressure chamber 23 communicates with a corresponding one of the nozzles 11*a* via respective communication passages 25 formed through respective thickness of the sheet members 20, 19, 18, 17, 16, 15 provided between the base sheet 21 and the nozzle sheet 11.

Thus, each of the four color inks is supplied to a corresponding one or ones of the five common ink chambers 26 via a corresponding one of the four ink supply inlets 31*a*, 31*b*, 31*c*, 31*d*, and then is distributed to the corresponding pressure chambers 23 via the corresponding restrictor passages 28 and the corresponding communication passages 29. The color ink outputted from each of the pressure chambers 23 is supplied to a corresponding one of the nozzles 11*a* via the corresponding communication holes 25.

Next, there will be described a construction of the piezoelectric actuator 12, by reference to FIG. 3. Like the piezoelectric actuator disclosed by Patent Document 1, the piezoelectric actuator 12 includes a plurality of piezoelectric sheets 33 that are stacked on each other, and a plurality of individual-electrode layers and a plurality of common-electrode layers that are alternately stacked over each other such that each of the electrode layers is sandwiched by each pair of piezoelectric sheets 33 adjacent to each other. Each of the individual-electrode layers includes the same number of individual electrodes 36 as the total number of the pressure chambers 23, such that the individual electrodes 36 are arranged in arrays in the same manner as the manner in which the pressure chambers 23 are arranged, and the individual electrodes 36 are located above the pressure chambers 23, respectively. Each of the common-electrode layers constitutes a common electrode 37 that is common to all the pressure chambers 23. Respective portions of the piezoelectric sheets 33 that are sandwiched by respective pairs of individual electrode 36 and common electrode 37 function as active portions 58. As is well known in the art, the active portions 58 are polarized, in advance, by applying a high voltage across the pairs of individual electrode 36 and common electrode 37. When an electric voltage is applied across an arbitrary one of the pairs of individual electrode 36 and common electrode 37, such that an electric field is produced in a direction parallel to the direction of polarization of the active portion 58 corresponding to the individual electrode 36, a strain is produced in the corresponding active portion 58 in a direction of stacking of the sheets 33 and the electrodes 36, 37, because of longitudinal piezoelectric effect.

The individual electrodes 36 and the common electrodes 37 are electrically connected to respective signal-line patterns formed in the flexible wiring substrate 40 via electrically conductive members, not shown, that are formed of a known material and extend through the piezoelectric sheets 33.

Next, there will be described an arrangement of the actuator control device 100 of the inkjet recording apparatus 1 that drives the piezoelectric actuator 12 so that the nozzles 11*a* eject respective droplets of inks, and a manner in which the control device 100 controls the actuator 12.

As shown in FIG. 4, the control device 100 includes a pulse control circuit 120, a charging circuit 121, and a discharging circuit 132. Each of the active portions 58 (and the corresponding pairs of individual electrode 36 and common electrode 37) of the piezoelectric actuator 12 is represented by a capacitor 140 equivalent to the each active portion 58. Reference numerals 140A, 140B denote two terminals of the capacitor 140.

An input terminal 131 of the charging circuit 121 is for inputting a pulse signal to apply an electric voltage, E (>0, V), to the capacitor 140 (i.e., each active portion 58); and an input terminal 133 of the discharging circuit 132 is for inputting a pulse signal to apply an electric voltage, 0 (V), to the capacitor 140. The charging circuit 121 includes resistors R101, R102, R103, R104, R105, and transistors TR101, TR102.

When an ON signal (+5 V) is inputted to the input terminal 131, the transistor TR101 receives a portion of the ON signal via the resistor R101 and becomes electrically conductive, so that an electric current flows from an electric-power source 137 (having a positive potential (+V)) to a collector, and then an emitter, of the transistor TR101 via the resistor R103. Thus, a divided voltage applied to the resistors R104, R105 connected to the power source 137 is increased, and an electric current flowing through a base of the transistor TR102 is increased, so that a collector and an emitter of the transistor TR102 become electrically conductive. Thus, the power source 137 applies an electric voltage of 20 V to the capacitor 140 via the collector and emitter of the transistor TR102 and a resistor R120, so that an electric charge corresponding to a capacitance of the capacitor 140 is charged to the terminal 140A.

Next, there will be described the discharging circuit 132. The discharging circuit 132 includes resistors R106, R107 and a transistor TR103. When an ON signal (+5 V) is inputted to the input terminal 133, the transistor TR103 receives an electric voltage divided by the resistors R106, R107. Thus, the transistor TR103 becomes electrically conductive, so that the terminal 140A of the capacitor 140 is grounded via the resistor TR120. Consequently the electric charge being applied to the active portion 58, i.e., the pair of individual electrode 36 and common electrode 37 is discharged.

Next, there will be described the pulse control circuit 120 that produces the pulse signal to be inputted to the input terminal 131 of the charging circuit 121, and the pulse signal to be inputted to the input terminal 133 of the charging circuit 132. The pulse control circuit 120 includes a CPU (central processing unit) 123 that implements various calculations; a RAM (random access memory) 124 that temporarily stores various sorts of data such as printing data; and a ROM (read only memory) 125 that stores a control program according to which the pulse control circuit 120 operates and additionally stores sequence data to produce ON and OFF signals at appropriate timings. The ROM 125 includes a first memory area or portion, not shown, that stores various control programs including an ink-droplet ejection control program; and a second memory area or portion, not shown, that stores drive-waveform data representing a first drive waveform, DW1, and a second drive waveform, DW2, each described later. More specifically described, sequence data representing an ejection pulse signal(s) and a cancel pulse signal(s), described later, and pulse data representing different pulse lengths and different pulse intervals that correspond to different predetermined temperature ranges (i.e., a low-pressure range, a room-temperature range, and a high-pressure range) are stored in the second memory area.

The control device 100 includes a temperature sensor 130 that detects a temperature (i.e., an environmental temperature) that is related to the inks, e.g., a temperature around the recording head 1. The first memory area of the ROM 125 stores a control program according to which the CPU 123 judges in which range out of the predetermined temperature ranges (i.e., the low-pressure range, the room-temperature range, and the high-pressure range) the environmental temperature detected by the temperature sensor 130 falls, and selects, from the second memory area of the ROM 125, one of the pulse lengths that corresponds to the temperature range in which the detected temperature fails, and one of the pulse intervals that corresponds to the same temperature range.

The CPU 123 is connected to an input-and-output (I/O) bus 126 that receives various inputted data and outputs various data, and the I/O bus 126 is connected to a printing-data receiver circuit 127, a first and a second pulse generator 128, 129, and the temperature sensor 130. An output of the first pulse generator 128 is connected to the input terminal 131 of the charging circuit 121, and an output of the second pulse generator 129 is connected to the input terminal 133 of the discharging circuit 132.

The CPU 123 controls each of the first and second pulse generators 128, 129, according to the sequence data stored in the second memory area of the ROM 125. The sequence data represent different sorts of drive-waveform patterns including one or more ejection pulse signals and/or one or more cancel pulse signals.

The pulse control circuit 120 includes the same number of first pulse generators 128, the same number of second pulse generators 129, the same number of charging circuits 121, and the same number of discharging circuits 132, as the total number of the ink ejection nozzles 11*a*. FIG. 4 shows only respective representative ones of the first pulse generators 128, the second pulse generators 129, the charging circuits 121, and the discharging circuits 132. However, all those elements 128, 129, 121, 132 are controlled in the same manner. Hence, hereinafter, there will be described the manner in which the pulse control circuit 120 controls the representative first pulse generator 128, second pulse generator 129, charging circuit 121, and discharging circuit 132, shown in FIG. 4, so as to drive the active portion 58 to eject droplets of ink from the representative nozzle 11*a*.

The present inkjet recording apparatus is constructed such that in an original or ordinary state thereof, a drive voltage E (>0, V) is applied to all the pairs of individual electrode 36 and common electrode 37, so as to produce respective electric fields parallel to the respective directions of polarization of all the active portions 58, thereby elongate those active portions in the direction of stacking of the piezoelectric sheets 33, and thereby decrease the respective volumes of all the pressure chambers 23. Thus, in the present embodiment, each pulse signal first falls to decrease the electric voltage applied to the individual electrode 36, to 0 (V), and then rises to increase or return the electric voltage applied to the individual electrode 36, to E (V). However, in the inkjet recording head disclosed by Patent Document 3, wherein a volume of a pressure chamber is increased upon application of an electric voltage to an active portion, each pulse signal first rises and then fills.

Figure 5:
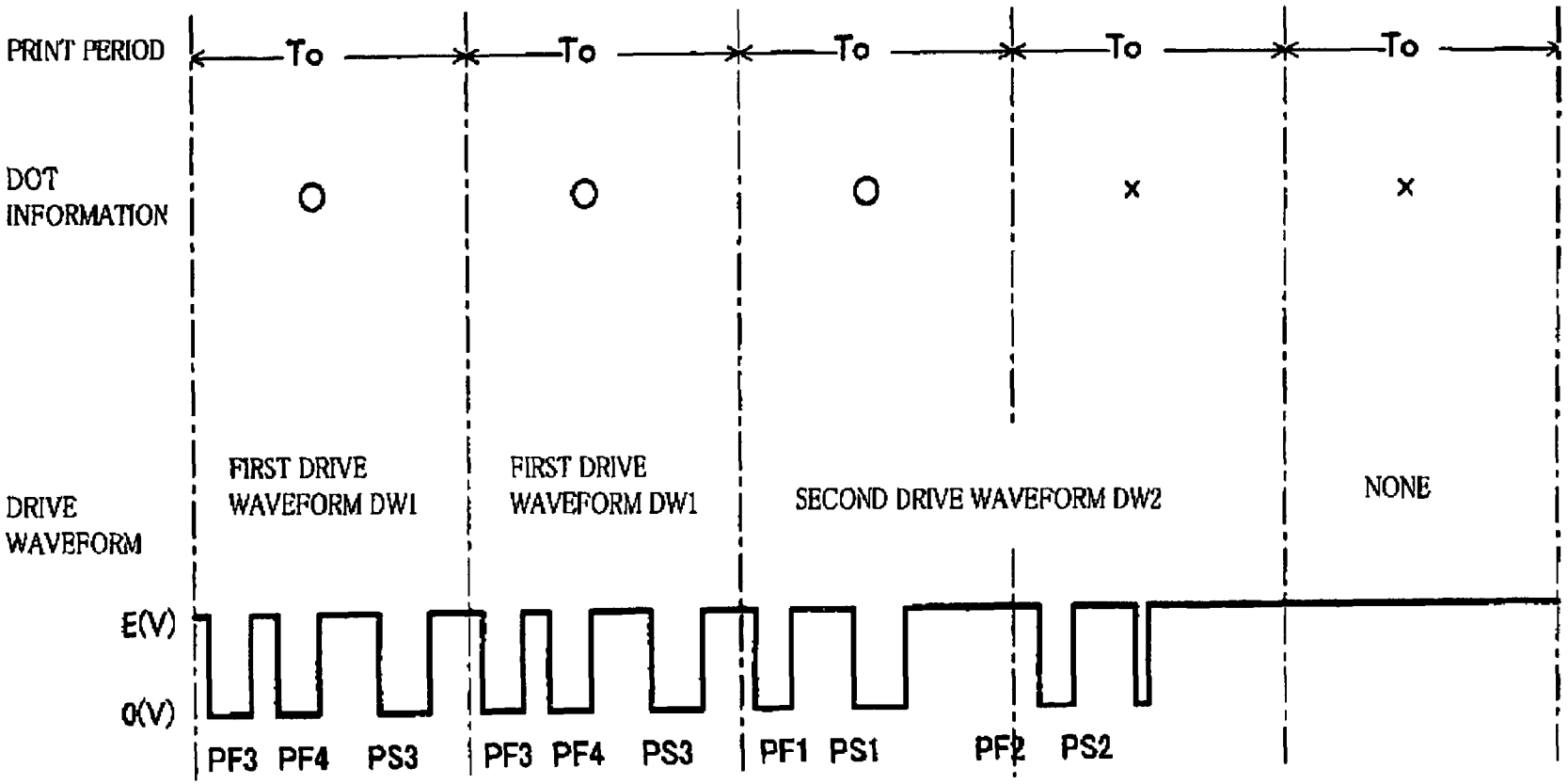
FIG. 5 is a view for explaining a first drive waveform and a second drive waveform each to produce one or two droplets of ink.

The principle of the present invention will be described by reference to FIG. 5. When the printing data received by the printing-data receiver circuit 127 include, as two consecutive sets of dot information corresponding to a current print period, $T_o$, and the next print period $T_o$, two ink ejection commands, respectively, the control device 100 produces a first drive waveform DW1 falling within a time duration of the current print period $T_o$; and, when the received printing data include, as the same two consecutive sets of dot information as described above, an ink ejection command and a non-ejection command, respectively, the control device 100 produces a second drive waveform DW2 falling within a time duration of the current and next ejection periods $T_o$ and bridging the two ejection periods $T_o$.

In the present embodiment, the first drive waveform DW1 corresponding to one print period To includes a first ejection pulse signal, PF3, a following, second ejection pulse signal, PF4, and a following, cancel pulse signal, PS3 within the one ejection period $T_o$. The first drive waveform DW1 will be described in more detail by reference to an upper half portion of FIG. 6. Each of the first and second ejection pulse signals PF3, PF4 has a pulse length, WF, equal to a product of 1.2 and a one-way propagation time, AL, described later (i.e., WF=1.2AL); and a time interval between a trailing end (i.e., a rise), FE3, of the first ejection pulse signal PF3 and a leading end (i.e., a fall), FS4, of the second ejection pulse signal PF4 is equal to 0.8AL. In addition, a time interval between a rise, FE4, of the second ejection pulse signal PF4 and a center, SC3, of the pulse length of the cancel pulse signal PS3 is equal to from 2.2AL to 2.8AL.

As described above, in the original or ordinary state of the present inkjet recording apparatus, the standard drive voltage E (V) is applied to all the pairs of individual electrode 36 and common electrode 37, so that the respective volumes of all the pressure chambers 23 are decreased. If the first ejection pulse signal PF3, applied to an arbitrary one of the individual electrodes 36, falls to 0 (V) at FS3, a corresponding one of the active portions 58 is returned from its elongated state to its normal state and accordingly a corresponding one of the pressure chambers 23 is returned from its shrunk state to its normal state, i.e., the volume of the corresponding pressure chamber 23 is increased. Consequently a negative pressure wave is produced in the pressure chamber 23, and is propagated in an ink flow passage in which the ink flows through the corresponding restrictor passage 28, the corresponding communication passage 29, that pressure chamber 23, and the corresponding communication holes 25 (communicated with the corresponding nozzle 11*a*), in the order of description. The negative pressure wave is inverted to a positive pressure wave after a one-way propagation time AL elapses. The one-way propagation time AL is a time needed for each pressure wave to propagate one way in the ink flow passage in a longitudinal direction thereof. Therefore, at a timing when the negative pressure wave is inverted to the positive pressure wave, the first pulse ejection pulse signal PF3 is increased to E (V) at FE3, so that the drive voltage E is again applied to the individual electrode 36 and accordingly the corresponding active portion 58 is again elongated. Thus, a positive pressure newly produced by the elongation of the active portion overlaps the inverted, positive pressure wave, so that a first ink droplet corresponding to the first ink ejection signal PF3 is ejected from the corresponding pressure chamber 23 via the corresponding nozzle 11*a*.

Subsequently, after the positive pressure wave, newly produced in the ink, is propagated one way in the ink flow passage, i.e., after another one-way propagation time AL elapses, i.e. at a timing when the new positive pressure wave is inverted to a negative pressure wave, the second ink ejection signal PF4 falls to 0 (V) at FS4, so that a negative pressure wave newly produced by the enlargement of the pressure chamber 23 overlaps the inverted, negative pressure wave and thereby amplify the negative pressure wave. Then, after another one-way propagation time AL elapses and the amplified negative pressure wave is inverted to a positive amplified pressure wave, the second ink ejection signal PF4 is increased to E (V) at FE4, so that a positive pressure wave newly produced by the elongation of the active portion 58 overlaps the inverted, positive amplified pressure wave. As a result, a second ink droplet corresponding to the second ink ejection signal PF4 is ejected at a speed higher than the speed at which the first ink droplet was ejected, so that the first and second ink droplets may collide, and unite, with each other in the air, or may reach or hit an sane point on the recording sheet.

When an appropriate time duration elapses after the rise FE4 of the second ink ejection pulse period PF4, i.e., at a timing when the negative pressure wave propagated in the ink is inverted to a positive pressure wave, the cancel pulse signal PS3 falls to 0 (V), so that the active portion 58 is returned from its elongated state to its normal state Since the volume of the pressure chamber 23 is increased, the inverted, positive pressure wave is substantially cancelled or offset and accordingly the residual pressure wave or vibration in the ink flow passage is effectively attenuated. Subsequently, at a timing when the residual pressure wave in the ink is inverted to a negative pressure wave, the cancel pulse signal PS3 is increased to E (V), so that the active portion 58 is elongated, the inverted, negative pressure wave is canceled, and the residual pressure wave or vibration is further attenuated. Thus, the influences of the residual pressure wave or vibration in the ink in the current print period $T_o$, to the next print period $T_o$, can be minimized.

Thus, the first drive waveform DW1 is produced when the printing data include, as two consecutive sets of dot information corresponding to a current print period $T_o$ and the next print period $T_o$, two ink ejection commands, respectively. If the first drive waveform DW1 is produced based on the set of dot information corresponding to the current print period $T_o$, an undesirable "satellite" ink droplet may hit, on the recording sheet, a spot corresponding to the next print period $T_o$. In this case, however, if the two spots corresponding to the current and next print periods $T_o$ are continuous with each other on the recording sheet, e.g., if a continuous straight line is drawn in a main-scan direction (i.e., the X direction), a quality of the image formed on the recording sheet is not adversely influenced.

On the other hand, when the printing data include, as two consecutive sets of dot information corresponding to a current print period $T_o$ and the next ejection period $T_o$, an ink ejection command and a non-ejection command, respectively, the control device 100 produces the second drive waveform DW2 failing within the time duration of the current and next print periods $T_o$ and bridging the two print periods $T_o$. In the present embodiment, the second drive waveform DW2 corresponding to two consecutive sets of dot information, i.e., two consecutive pixels includes a first ejection pulse signal, PF1, a following, first cancel pulse signal, PS1, a following, second ejection pulse signal, PF2, and a following, second cancel pulse signal, PS2 within the current and following print periods $T_o$. The first ejection pulse signal PF1 and the first cancel pulse signal PS1 fall in the current print period $T_o$, and the second ejection pulse signal PF2 and the second cancel pulse signal PS2 fall in the next print period $T_o$.

Figure 6:
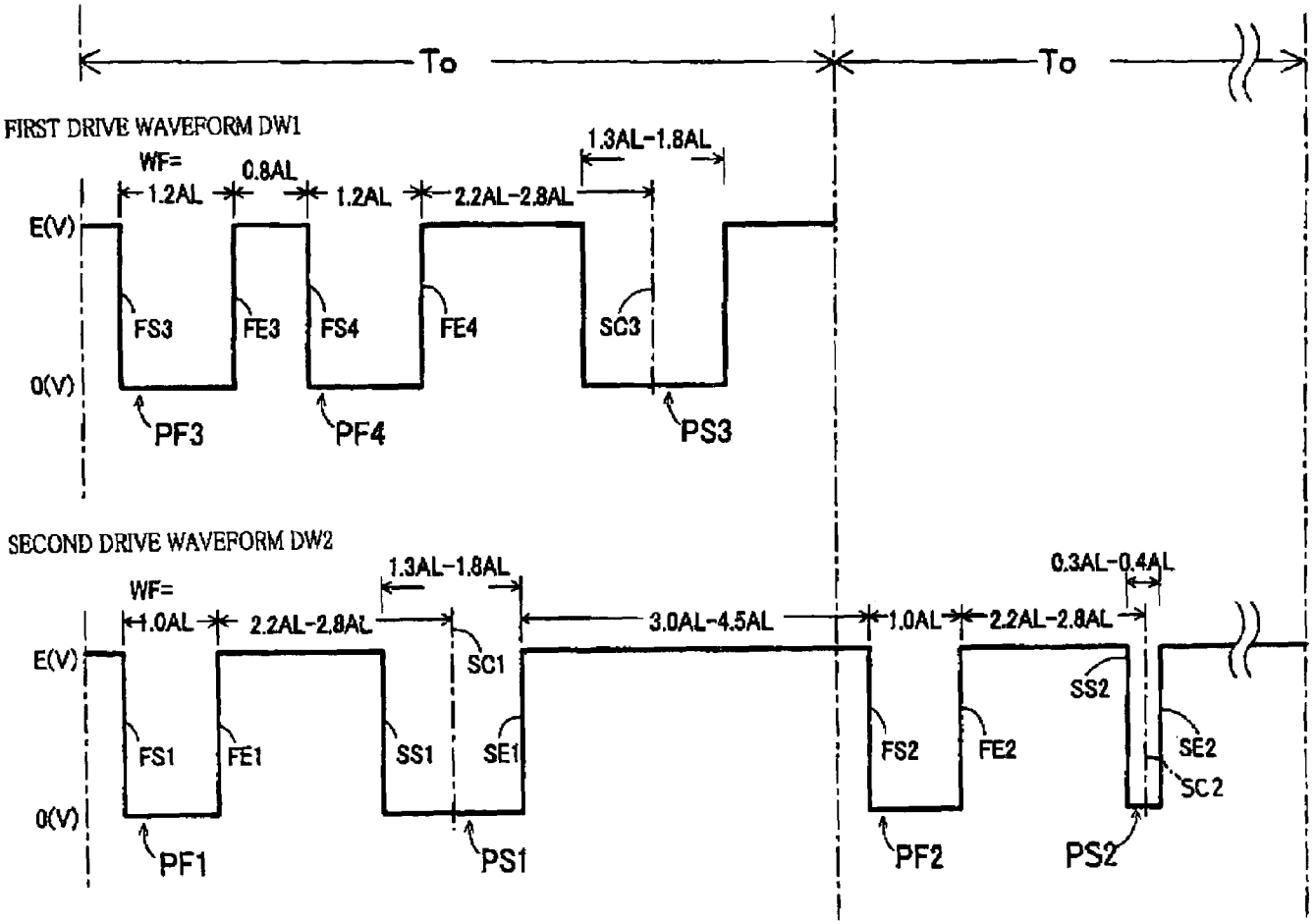
FIG. 6 is a view for illustrating each of the first drive waveform and the second drive waveform in more detail.

The second drive waveform DW2 will be described in more detail by reference to a lower half portion of FIG. 6. Each of the first and second ejection pulse signals PF1, PF2 has a pulse length WF equal to a product of 1.0 and a one-way propagation time AL (i.e., WF=1.0AL); the first cancel pulse signal PS1 has a pulse length WF equal to from 1.5AL to 1.8AL; and the second cancel pulse signal PS2 has a pulse length WF equal to from 0.3AL to 0.4AL. In addition, each of (a) a time interval between a trailing end, FE1, of the first ejection pulse signal PF1 and a center, SC1, of the pulse length of the first cancel pulse signal PS1 and (b) a time interval between a trailing end, FE2, of the second ejection pulse signal PF2 and a center, SC2, of the pulse length of the second cancel pulse signal PS2 is equal to from 2.2AL to 2.8AL; and a time interval between a trailing end, SE1, of the first cancel pulse signal PS1 and a leading end, FS2, of the second ejection pulse signal PF2 is equal to from 3.0AL to 4.5AL.

Thus, the second drive waveform DW2 has the cancel pulse PS1 between the two ejection pulses PF1, PF2. However, two ink droplets corresponding to the two ejection pulses PF1, PF2 overlap each other, and record one dot, on the recording sheet. In addition, the second drive waveform DW2 bridges the two print periods $T_o$. However, since a first pitch at which dots are recorded according to first drive waveforms DW1 is very small, a deviation of a second pitch at which dots are recorded according to second drive waveforms DW2, from the first pitch, cannot be recognized by a human person.

The second drive waveform DW2 produces two ink droplets respectively corresponding to the two ejection pulses PF1, PF2 the length WF of each of which is equal to about 1.0AL. Thus, each ink droplet is ejected with a high efficiency and accordingly in a large volume. On the other hand, the first drive waveform DW1 produces two ink droplets respectively corresponding to the two ejection pulses PF3, PF4 the length WF of each of which is equal to about 1.2AL. Thus, each ink droplet is ejected with a somewhat lower efficiency. However, since the two ink droplets are united with each other in the air, the united ink droplet can enjoy a large volume comparable to that of each ink droplet produced by the second drive waveform DW2.

If it is attempted to output the first drive waveforms DW1 at as high as possible a frequency, then the second drive waveform DW2 longer than the first drive waveform DW1 cannot be outputted in the shortest print period in which each first drive waveform DW1 is outputted. However, in the case where a print command corresponding to a current print period is to eject ink and a print command corresponding to the next print period is not to eject ink, the second drive waveform DW2 longer than each first drive waveform DW1 can be outputted in the current and next print periods, i.e., the two print periods. Thus, the first drive waveforms DW1 can be outputted at as high as possible a frequency. In addition, if the print command corresponding to the next print period is not to eject ink, the second drive waveform DW2 is outputted such that each of the two ejection pulses PF1, PF2 is followed by a corresponding one of the two cancel pulses PS1, PS2. Thus, the inks can be ejected with high stability and accordingly images can be printed with high quality.

In the case where the printing data include ink ejection commands that are discontinued from each other, e.g., include an ink ejection command with respective to every second, third, or fourth print period, it is difficult, though the first drive waveforms DW1 include the respective cancel pulses PS3, to eject respective droplets of ink with stability, because the respective pressure waves caused by those cancel pulses are superposed, in different manners, on the corresponding residual pressure waves. In this case, however, the above-descried second drive waveforms DW2 can eject respective droplets of ink with stability.

FIGS. 7A, 7B, 7C, 7D, 7E, and 7F show six tables representing respective results of six experiments 1 through 6 with respect to six different second drive waveforms DW2 in which respective pulse lengths of the first and second cancel pulses PS1, PS2 and a time interval between the first cancel pulse PS1 and the second ejection pulse PF2 are changed. In each of the six experiments 1 through 6, a duty percentage (%) at which the printing data include sets of dot information corresponding to ink ejection commands, relative to all the print periods $T_o$, is changed and a drive frequency (kHz; in other words, the print period $T_o$) is changed.

In addition, in each of the six experiments 1 through 6, respective lengths of the first and second ejection pulses PF1, PF2 of each second drive waveform DW2 are equal to each other, i.e., 1.0AL, and a time interval between the rise FE1 of the first ejection pulse PF1 and the center of the length of the first cancel pulse PS1 and a time interval between the rise FE2 of the second ejection pulse PF2 and the center of the length of the second cancel pulse PS2 are equal to each other, i.e., from 2.2AL to 2.8AL.

Figure 9:
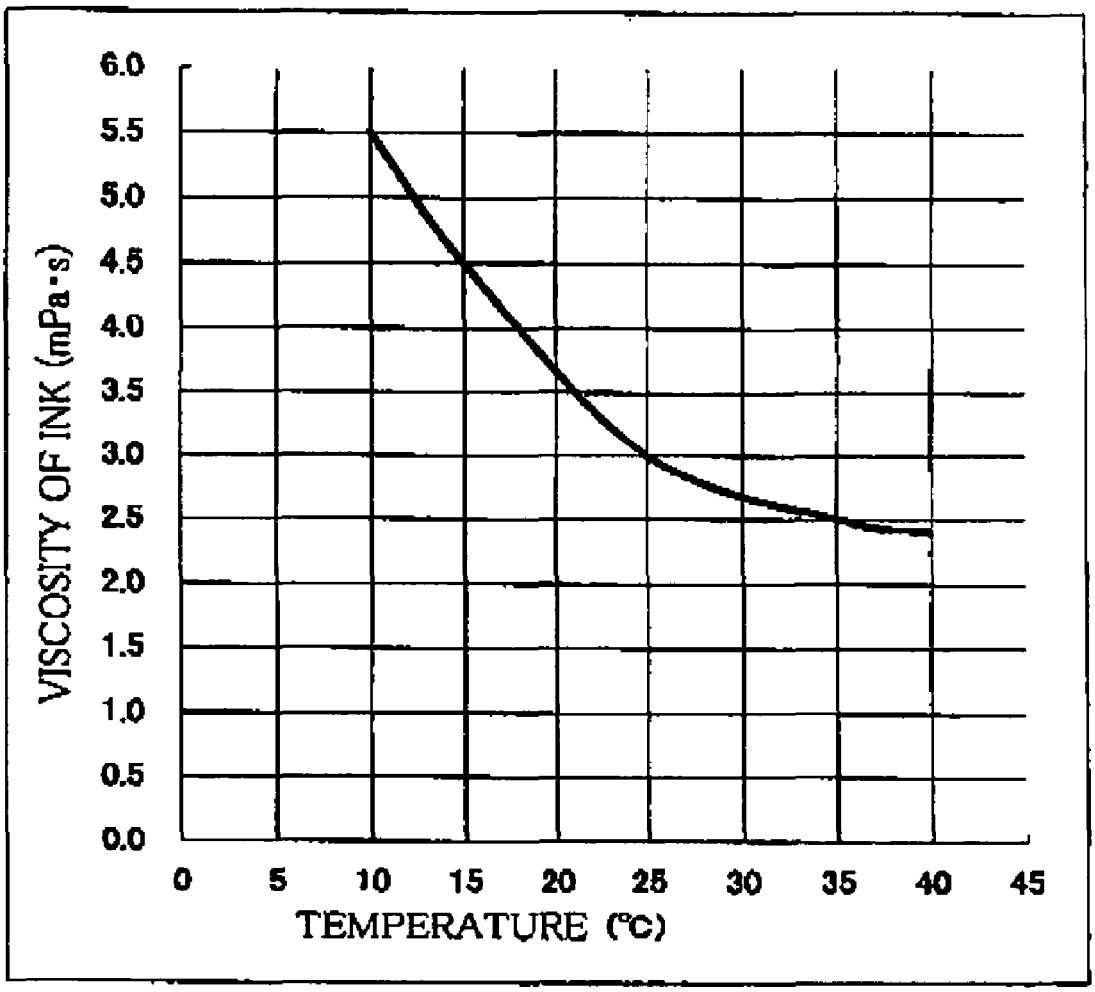
FIG. 9 is a graph representing a relationship between environmental temperature and ink viscosity.

The one-way propagation time AL is defined by various factors, e.g., a resistance of each ink flow passage including the corresponding pressure chamber 23 to the flow of ink therethrough; a viscosity of ink; and a rigidity (or a modulus of longitudinal elasticity) of each of the sheet members 11, 15, 16, 17, 18, 19, 20, 21, but is largely influenced by the viscosity of ink. Generally, the viscosity of ink decreases as temperature increases, and increases as temperature decreases, as shown in FIG. 9. Inks each having a viscosity of 2.5 mPa·s (milli-Pascal seconds) in the high-temperature range is used.

In particular, in the case where printing is performed in the high-temperature range and a printing speed is high (i.e., an ink-ejection frequency (i.e., a drive frequency) is high), unstable printing may occur, for example, a droplet of ink may be ejected toward a position on the recording sheet where no ink should be ejected, after a droplet of ink is ejected toward a position where ink should be ejected. Therefore, in experiments 1 through 6, described below, a one-way propagation time $AL_H$ that corresponds to the high-temperature range in which an environmental temperature is higher than 30° C. and that is equal to 5 μs (microseconds) is used. In addition, the drive frequency is changed in a range of 20 kHz±10% and a range of 24 kHz±10%.

In the tables shown in FIGS. 7A through 7F, symbol "○" indicates that all the nozzles 11*a* ejected droplets of inks with stability; symbol "Δ" indicates that droplets of inks ejected toward a recording sheet were deflected in wrong directions; and symbol "×" indicates that droplets of inks ejected from the nozzles 11*a* could not reach a recording sheet, or scattered in the air.

In experiments 1 through 6, the duty percentage at which the printing data include sets of dot information corresponding to ink ejection commands, relative to all the print periods $T_o$, is changed to each of four values, i.e., 50.0%, 33.0%, 25.0%, and 12.5%. As shown in FIG. 8, when the duty percentage is 50%, a droplet of ink is ejected in every print period; when the duty percentage is 33%, a droplet of ink is ejected in each of the first and second print periods of every three consecutive print periods; when the duty percentage is 25%, a droplet of ink is ejected in each of the first and second print periods of every four consecutive print periods; and when the duty percentage is 12.5%, a droplet of ink is ejected in each of the first and second print periods of every eight consecutive print periods.

Experiment 1—FIG. 7A

In this experiment, respective pulse lengths WF of the first and second ejection pulses PF1, PF2 are equal to 1.0AL (this is true with all experiments 1 through 6). Respective pulse lengths of the first and second cancel pulses PS1, PS2 are equal to from 1.3AL to 1.8AL. A time interval between the rise SE1 of the first cancel pulse PS1 and the fail FS2 of the second ejection pulse PF2 is equal to from 3.0AL to 4.5AL. The results of this experiment show that when the duty percentage is equal to 50.0% or 25.0%, the ink ejections are bad ("×") with respect to the entire frequency range of from 18 kHz to 26.4 kHz; when the duty percentage is equal to 12.5%, the ink ejections are good ("○") with respect to the entire frequency range; and when the duty percentage is equal to 33.0%, the ink ejections are deflected ("Δ") with respect to a frequency range of from 25.2 kHz to 26.4 kHz.

Experiment 2—FIG. 7B

In this experiment, respective pulse lengths of the first and second cancel pulses PS1, PS2 are equal to from 0.3AL to 0.4AL. A pulse interval between the rise SE1 of the first cancel pulse PS1 and the fall FS2 of the second ejection pulse PF2 is equal to from 3.0AL to 4.5AL. The results of this experiment show that when the duty percentage is equal to 12.5%, the ink ejections are good ("○") with respect to the entire frequency range; when the duty percentage is equal to 50.0% or 33.0%, the ink ejections are bad ("×") with respect to the entire frequency range; and when the duty percentage is equal to 25.0%, the ink ejections are deflected ("Δ") with respect to a frequency range of from 24.0 kHz to 26.4 kHz.

Experiment 3—FIG. 7C

In this experiment, a pulse length of the first cancel pulse PS1 is equal to from 0.3AL to 0.4AL and a pulse length of the second cancel pulse PS2 is equal to from 1.3AL to 1.8AL. A pulse interval between the rise SE1 of the first cancel pulse PS1 and the fall FS2 of the second ejection pulse PF2 is equal to from 3.0AL to 4.5AL. The results of this experiment show that when the duty percentage is equal to 12.5%, the ink ejections are good ("○") with respect to the entire frequency range; when the duty percentage is equal to 50.0%, the ink ejections are deflected ("Δ") with respect to a wide frequency range of from 21 kHz to 26.4 kHz; and when the duty percentage is equal to 33.0%, the ink ejections are deflected or bad ("×") with respect to a wide frequency range of from 21 kHz to 26.4 kHz. In addition, when the duty percentage is equal to 25.0%, the ink ejections are bad with respect to a frequency range of from 18 kHz to 20 kHz.

Experiment 4—FIG. 7D

In this experiment, a pulse length of the first cancel pulse PS1 is equal to from 1.3AL to 1.8AL and a pulse length of the second cancel pulse PS2 is equal to from 0.3AL to 0.4AL. A pulse interval between the rise SE1 of the first cancel pulse PS1 and the fall FS2 of the second ejection pulse PF2 is equal to from 0.5AL to 2.5AL. The results of this experiment show that when the duty percentage is equal to 12.5%, the ink ejections are good ("○") with respect to the entire frequency range; when the duty percentage is equal to 50.0%, the ink ejections are deflected ("Δ") or bad ("×") with respect to a wide frequency range of from 21 kHz to 26.4 kHz; and when the duty percentage is equal to 33.0%, the ink ejections are deflected or bad with respect to a wide frequency range of from 22 kHz to 26.4 kHz. In addition, when the duty percentage is equal to 25.0%, the ink ejections are deflected or bad with respect to a frequency range of from 18 kHz to 20 kHz.

Experiment 5—FIG. 7E

In this experiment, a pulse length of the first cancel puke PS1 is equal to from 1.3AL to 1.8AL and a pulse length of the second cancel pulse PS2 is equal to from 0.3AL to 0.4AL. A pulse interval between the rise SE1 of the first cancel pulse PS1 and the fall FS2 of the second ejection pulse PF2 is equal to from 5.0AL to 6.0AL. The results of this experiment show that when the duty percentage is equal to 12.5%, the ink ejections are good ("○") with respect to the entire frequency range; when the duty percentage is equal to 50.0%, the ink ejections are deflected ("Δ") or bad ("×") with respect to a wide frequency range of from 21.6 kHz to 26.4 kHz; and when the duty percentage is equal to 33.0%, the ink ejections are deflected with respect to the entire frequency range. In addition, when the duty percentage is equal to 25.0%, the ink ejections are deflected with respect to a frequency range of from 22 kHz to 26.4 kHz.

Experiment 6—FIG. 7F

In this experiment, a pulse length of the first cancel pulse PS1 is equal to from 1.3AL to 1.8AL and a pulse length of the second cancel pulse PS2 is equal to from 0.3AL to 0.4AL. A pulse interval between the rise SE1 of the first cancel pulse PS1 and the fall FS2 of the second ejection pulse PF2 is equal to from 3.0AL to 4.5AL. The results of this experiment show that when the duty percentage is equal to each of 50.0%, 33.0%, 25.0%, and 12.5%, the ink ejections are good ("○") with respect to the entire frequency range.

If the pulse-related parameters of the second drive waveform DW2 are defined as described above, failure of ejection of an ink droplet or deflection of an ejected ink droplet does not occur even if droplets of ink may be ejected at an arbitrary time interval at a high environmental temperature and a high printing speed. Thus, images can be printed with stable quality.

In the illustrated embodiment, each of the first and second ejection pulse signals PF1, PF2 of the second drive waveform DW2 is applied to the piezoelectric actuator 12 so as to drive the actuator 12 to first increase the volume of the pressure chamber 23 and subsequently decrease the increased volume, and thereby produce a corresponding one of the two pressure waves in the pressure chamber 23. The increased volume of the pressure chamber 23 is returned to its initial volume after about the one-way propagation time AL. Thus, ink droplets can be ejected with a high efficiency relative to the displacement of the pressure chamber 23.

In addition, in the illustrated embodiment, each of the first and second canceling pulse signals is outputted in a time duration whose middle time is subsequent, by a time falling in a range of from 2.2AL to 2.8AL, to a trailing end of one of the first and ejecting pulse signals that precedes the each canceling pulse signal. Therefore, each of the first and second ink droplets can be ejected stably and crisply.

In addition, in the illustrated embodiment, the open end of each nozzle 11*a* that opens toward the space outside the recording head 1 has the diameter of from 18 μm to 22 μm, and the one-way propagation time AL is equal to 5 μsec. Since the diameter of the nozzles 11*a* is smaller than that of the nozzles of the conventional inkjet recording heads, and the one-way propagation time AL is shorter than that of the conventional inkjet recording heads, ink droplets can be ejected with stability, and quality of recorded images can be improved.

In addition, in the illustrated embodiment, the print periods To have the frequency falling in the range of from 18 kHz to 26.4 kHz. Thus, the piezoelectric actuator 12 can be driven at high frequencies.

In addition, in the illustrated embodiment, each of the four color inks has a viscosity of not higher than 2.5 mPa·sec. Thus, ink droplets can be ejected with stability even at high temperatures at which the viscosity of each ink is low, i.e., from 0 to 2.5 mPa·sec.

It is to be understood that the present invention may be embodied with other changes and improvements that may occur to a person skilled in the art, without departing from the spirit and scope of the invention defined in the claims.

What is claimed is:

1. An ink-droplet ejecting apparatus, comprising:

a nozzle from which a droplet of an ink is ejected;

a pressure chamber which is filled with the ink and is connected to the nozzle;

an actuator which changes a volume of the pressure chamber and thereby changes a pressure of the ink in the pressure chamber; and a control device which, when a first print command corresponding to a first pixel and a first print period is to eject the ink and a second print command corresponding to a second pixel next to the first pixel and a second print period next to the first print period is to eject the ink, outputs, within the first print period, a first drive waveform so as to drive, a plurality of times, the actuator to produce a plurality of pressure waves, respectively, in the pressure chamber and thereby eject a plurality of droplets of the ink, respectively, from the nozzle to form the first pixel, and which, when the first print command is to eject the ink and the second print command is not to eject the ink, outputs a second drive waveform extending over the first and second print periods, wherein the control device outputs, as the second drive waveform, a first ejecting pulse signal, then a first canceling pulse signal, then a second ejecting pulse signal, and then a second canceling pulse signal, so as to drive, two times, the actuator to produce two pressure waves, respectively, in the pressure chamber and thereby eject two droplets of the ink, respectively, from the nozzle to form the first and second pixels, respectively, wherein each of the first and second ejecting pulse signals has a pulse length falling in a range of from 0.8AL to 1.2AL, where AL is a one-way propagation time needed for each of the two pressure waves to propagate one way in an ink flow passage which includes the pressure chamber and is connected to the nozzle, wherein the first canceling pulse signal has a pulse length falling in a range of from 1.3AL to 1.8AL, wherein the second canceling pulse signal has a pulse length falling in a range of from 0.3AL to 0.4AL, and wherein a time interval between a trailing end of the first canceling pulse signal and a leading end of the second ejecting pulse signal fills in a range of from 3.0AL to 4.5AL.

2. The ink-droplet ejecting apparatus according to claim 1, wherein the control device outputs each of the first and second ejecting pulse signals of the second drive waveform, such that the actuator is driven to first increase the volume of the pressure chamber and subsequently decrease the volume and thereby produce a corresponding one of the two pressure waves in the pressure chamber.

3. The ink-droplet ejecting apparatus according to claim 1, wherein the control device outputs each of the first and second canceling pulse signals in a time duration whose middle time is subsequent, by a time falling in a range of from 2.2AL to 2.8AL, to a trailing end of one of the first and second ejecting pulse signals that precedes said each canceling pulse signal.

4. The ink-droplet ejecting apparatus according to claim 1, wherein an open end of the nozzle that opens in a space outside the apparatus has a diameter of 18 μm to 22 μm, and wherein the one-way propagation time AL falls in a range of from 4.5 μsec to 5.5 μsec.

5. The ink-droplet ejecting apparatus according to claim 1, wherein the first and second print periods have a frequency falling in a range of from 18 kHz to 26.4 kHz.

6. The ink-droplet ejecting apparatus according to claim 1, further comprising the ink which has a viscosity of not higher than 2.5 mPa·sec.

7. The ink-droplet ejecting apparatus according to claim 1, comprising a plurality of said nozzles; a plurality of said pressure chambers each of which is filled with the ink and is connected to a corresponding one of the nozzles; a plurality of said ink flow passages; and a plurality of said actuators each of which changes a volume of a corresponding one of the pressure chambers and thereby changes a pressure of the ink in said one pressure chamber, wherein the apparatus further comprises a common ink chamber which accommodates the ink and which is connected to each of the pressure chambers, and wherein each of the ink flow passages includes a first communication passage through which the common ink chamber communicates with a corresponding one of the pressure chambers, and a second communication passage through which said one pressure chamber communicates with a corresponding one of the nozzles.

* * * * *